US008621880B2

(12) United States Patent
Kim et al.

(10) Patent No.: US 8,621,880 B2
(45) Date of Patent: Jan. 7, 2014

(54) AIR CONDITIONER AND METHOD FOR CONTROLLING THE SAME

(75) Inventors: Won Seok Kim, Changwon-si (KR); Jie Seop Sim, Changwon-si (KR)

(73) Assignee: LG Electronics Inc., Seoul (KR)

( * ) Notice: Subject to any disclaimer, the term of this patent is extended or adjusted under 35 U.S.C. 154(b) by 959 days.

(21) Appl. No.: 12/451,465

(22) PCT Filed: Oct. 22, 2007

(86) PCT No.: PCT/KR2007/005185

§ 371 (c)(1),
(2), (4) Date: Mar. 24, 2010

(87) PCT Pub. No.: WO2008/153249

PCT Pub. Date: Dec. 18, 2008

(65) Prior Publication Data

US 2010/0206539 A1 Aug. 19, 2010

(30) Foreign Application Priority Data

Jun. 14, 2007 (KR) ..... 10-2007-0058511

(51) Int. Cl.
*F25D 21/06* (2006.01)

(52) U.S. Cl.
USPC ..... 62/154; 62/155; 62/156; 62/272

(58) Field of Classification Search
USPC ..... 62/80, 128, 151, 154, 155, 272, 275, 62/156; 340/580
See application file for complete search history.

(56) References Cited

U.S. PATENT DOCUMENTS

| | | | | |
|---|---|---|---|---|
| 6,298,679 | B1 * | 10/2001 | Cheng et al. | 62/275 |
| 6,332,331 | B1 * | 12/2001 | Cheng et al. | 62/275 |
| 6,397,619 | B1 * | 6/2002 | Cheng et al. | 62/272 |
| 6,658,882 | B2 * | 12/2003 | Ohama et al. | 62/262 |

FOREIGN PATENT DOCUMENTS

| | | |
|---|---|---|
| CN | 1517619 A | 8/2004 |
| JP | 06-317366 | 11/1994 |
| JP | 07-091782 | 4/1995 |
| JP | 2001-174030 | 6/2001 |
| JP | 2003-161499 | 6/2003 |
| JP | 2007-093071 | 4/2007 |

* cited by examiner

*Primary Examiner* — Marc Norman

(74) *Attorney, Agent, or Firm* — McKenna Long & Aldridge LLP

(57) ABSTRACT

An air conditioner is provided. The air conditioner includes a heat exchanger which exchanges heat with air by passing a coolant therethrough; and an anti-freeze apparatus which prevents the freeze of water on the surface of the heat exchanger by supplying energy to the heat exchanger. The air conditioner can prevent the freeze of water on the surface of the heat exchanger during its operation, and thus, there is no need to perform a defrost operation during the operation of the air conditioner. In addition, the air conditioner can continuously and efficiently perform an air conditioning function.

5 Claims, 8 Drawing Sheets o REFERENCE CURVE(0W)
V FIFTH ENERGY CURVE(0.36W)
IV FOURTH ENERGY CURVE(0.62W)
III THIRD ENERGY CURVE(0.91W)
II SECOND ENERGY CURVE(0.98W)
I FIRST ENERGY CURVE(1.38W)

AIR CONDITIONER AND METHOD FOR CONTROLLING THE SAME

This application is a 35 U.S.C. §371 National Stage entry of International Application No. PCT/KR2007/005185, filed on Oct. 22, 2007, which claims priority to Korean Application No. 10-2007-0058511, filed Jun. 14, 2007, both of which are hereby incorporated by reference in their entireties as if fully set forth herein.

TECHNICAL FIELD

The present invention relates to an air conditioner and a method of controlling the same, and more particularly, to an air conditioner and a method of controlling the same in which the surface of a heat exchanger can be prevented from freezing by supplying energy to the heat exchanger.

BACKGROUND ART

Air conditioners are devices for cooling and cooling indoor rooms using a cooling cycle including a compressor, a condenser, an expansion device, and an evaporator. During the operation of a cooling cycle of an air conditioner, i.e., during the operation of a compressor, water in the air is condensed on the surface of an evaporator, and thus, compressed water is generated. Then, the compressed water drops below the evaporator. However, if the compressed water freezes up on the surface of the evaporator due to low-temperature air around the evaporator, the performance of the air conditioner may deteriorate due to an unsmooth heat exchange between a coolant and air.

In order to address this, the operation of a compressor may be stopped in the middle of the operation of an air conditioner so that the operation of the air conditioner can also be stopped. Then, a defrost operation may be performed for a predetermined amount of time so that the surface of an evaporator can be defrosted. Once the surface of the evaporator is completely defrosted, the operation of the compressor may be resumed so that the operation of the air conditioner can be resumed.

However, since a defrost operation can be performed only after the operation of an air conditioner is stopped, a cooling function or a heating function cannot be performed during a defrost operation, thereby reducing user convenience.

DISCLOSURE

Technical Problem

The present invention provides an air conditioner which can prevent water on the surface of a heat exchanger from freezing and can thus prevent its performance from deteriorating due to water freezing on the surface of the heat exchanger.

The present invention also provides an air conditioner which can prevent water from freezing while performing its functions and can thus maximize user convenience.

The present invention also provides a method of controlling an air conditioner in which water on the surface of a heat exchanger can be prevented from freezing by consuming less power.

Technical Solution

According to an aspect of the present invention, there is provided an air conditioner including a heat exchanger which exchanges heat with air by passing a coolant therethrough;

and an anti-freeze apparatus which prevents the freeze of water on the surface of the heat exchanger by supplying energy to the heat exchanger.

The anti-freeze apparatus may include an electric field generation unit which generates an electric field in the heat exchanger.

The electric field generation unit may include a plurality of electrodes which are disposed on opposite sides of the heat exchanger.

The air conditioner may also include an isolation unit which isolates the heat exchanger from the electrodes.

The heat exchanger may have round edges.

Bottoms of the electrodes may be disposed lower than a bottom of the heat exchanger, and tops of the electrodes may be disposed higher than a top of the heat exchanger.

The air conditioner may also include a plurality of electrode units which are arranged in different directions.

The air conditioner may also include a control unit which sequentially applies a voltage to the electrode units.

The heat exchanger and the electrodes may have round edges, and the air conditioner may also include a plurality of electrode units which are arranged along an outer circumference of the heat exchanger.

The air conditioner may also include a plurality of electrode covers which are formed of a dielectric material and in which the respective electrodes are installed.

Each of the electrode covers may include an electrode box which has one surface opened and can thus hold a corresponding electrode therein and a cover which covers the opened surface of the electrode box.

The electrode covers may be formed through injection molding so that the electrodes can be respectively inserted in the electrode covers.

The air conditioner may also include wires which connect a voltage generation unit and the electrodes, wherein each of the electrode covers includes a wire through hole through which the wires pass.

The anti-freeze apparatus may also include a voltage generation unit which applies a voltage to the electric field generation unit.

The air conditioner may also include a casing which includes an air inlet and an air outlet through which air is injected and ejected; and a barrier wall which divides the inner space of the casing into a machine room in which a compressor is disposed and a flow path room in which the heat exchanger is disposed, wherein the electric field generation unit is disposed in the flow path room.

The voltage generation unit may be disposed in either the machine room or the flow path room.

The air conditioner may also include a dielectric element which covers the voltage generation unit.

The barrier wall may be formed of a dielectric material.

The anti-freeze apparatus may also include wires which are connected to the electric field generation unit or the voltage generation unit and the barrier wall includes a wire through hole through which the wires pass.

The air conditioner may also include a fan which is disposed in the flow path room, injects air through the air inlet and ejects the air through the air outlet; and an air guide which is disposed in the flow path room, guides the path of flow of air circulated by the fan and is formed of a dielectric material.

The air guide may include a container in which the heat exchanger is contained, and the electric field generation unit may be installed in the air guide so as to be able to generate an electric field in the container.

The air conditioner may be a heat pump including a compressor, a cooling/heating switching valve, an outdoor heat exchanger, an expansion device, and an indoor heat exchanger, and the anti-freeze apparatus may supply energy to the outdoor heat exchanger during a heating operation of the heat pump.

According to another aspect of the present invention, there is provided a method of controlling an air conditioner, the method including performing an anti-freeze operation by applying a voltage to one or more electrodes for generating in a heat exchanger an electric field that interferes with the freeze of water if the heat exchanger satisfies a set of anti-freeze initiation conditions; and canceling the anti-freeze operation by cutting off the voltage if the heat exchanger satisfies a set of anti-freeze release conditions.

The performing the anti-freeze operation, may include reducing an operating capacity of the air conditioner to be lower than when no voltage is applied to the electrodes.

The performing the anti-freeze operation, may include reducing the voltage or a frequency applied to the electrodes a predefined amount of time after the initiation of the anti-freeze operation.

Advantageous Effects

The air conditioner according to the present invention prevents the freeze of water on the surface of a heat exchanger during its operation. Thus, there is no need to perform a defrost operation, and it is possible to continuously perform an air conditioning function.

The air conditioner according to the present invention includes an anti-freeze apparatus which has an electric field generation unit that generates an electric field in the heat exchanger and a voltage generation unit that applies a voltage to the electric field generation unit. Thus, the air conditioner according to the present invention has higher durability and higher reliability than a conventional air conditioner including an anti-freeze apparatus having a mechanical vibrator.

The electric field generation unit of the air conditioner according to the present invention includes a plurality of electrodes that are disposed on the opposite sides of the heat exchanger. Thus, the air conditioner according to the present invention can easily prevent the freeze of water on the surface of the heat exchanger.

The electric field generation unit of the air conditioner according to the present invention is disposed in a flow path room. Thus, the air conditioner according to the present invention can prevent an electric field generated by the electric field generation unit from adversely affecting electronic elements in a machine room and can thus have high reliability.

The voltage generation unit of the air conditioner according to the present invention may be disposed in the flow path room. In this case, heat generated by the voltage generation unit is dissipated by air that passes through the flow path room, thereby improving safety.

The voltage generation unit of the air conditioner according to the present invention may be disposed in the machine room. In this case, it is possible to minimize the probability of the voltage generation unit malfunctioning due to an electric field.

The air conditioner according to the present invention also includes a dielectric element and can thus minimize the probability of the voltage generation unit malfunctioning due to being in contact with wires.

The air conditioner according to the present invention also includes a barrier wall which divides the inner space of a casing into the machine room and the flow path room. Thus, the air conditioner according to the present invention can effectively insulate the electric field generation unit from the machine room and can thus improve safety.

The air conditioner according to the present invention also includes a wire through hole which is formed through the barrier wall and through which wires that need to be connected to the electric field generation unit or the voltage generation unit can pass. Thus, it is possible to effectively arrange wires.

The air conditioner according to the present invention also includes a fan which is disposed in the flow path room and an air guide which is formed of a dielectric material and guides the flow of air circulated by the fan. Thus, it is possible to improve safety.

The air conditioner according to the present invention also includes a container which is disposed in the air guide and can hold the heat exchanger therein. In addition, the electric field generation unit is disposed in the air guide and generates an electric field in the container. Thus, there is no need to provide an additional element for installing the electric field generation unit, and it is possible to minimize the manufacturing cost of an air conditioner.

The air conditioner according to the present invention also includes a control unit which controls the anti-freeze apparatus according to the operating conditions of the corresponding air conditioner. Thus, it is possible to prevent the generation of an unnecessary electric field and to minimize the power consumption of an air conditioner.

The air conditioner according to the present invention may be a heat pump including a compressor, a cooling/heating switching valve, an outdoor heat exchanger, an expansion device and an indoor heat exchanger. In this case, the anti-freeze apparatus supplies energy to the outdoor heat exchanger during a heating operation of the heat pump. Thus, it is possible to continuously perform a heating operation even when the outdoor temperature is maintained to be low for a long time.

The method of controlling an air conditioner according to the present invention includes performing an anti-freeze operation by applying a voltage to one or more electrodes for generating in a heat exchanger an electric field that interferes with the freeze of water if the heat exchanger satisfies a set of anti-freeze initiation conditions; and canceling the anti-freeze operation by cutting off the voltage if the heat exchanger satisfies a set of anti-freeze release conditions. Thus, it is possible to prevent the freeze of water while consuming less power.

The method of controlling an air conditioner according to the present invention also includes reducing the operating capacity of an air conditioner during an operation of an anti-freeze apparatus. Thus, it is possible to stably perform an anti-freeze operation while preventing fluctuations in the temperature of water and to prevent the probability of the malfunction of an air conditioner.

BEST MODE

Figure 1:
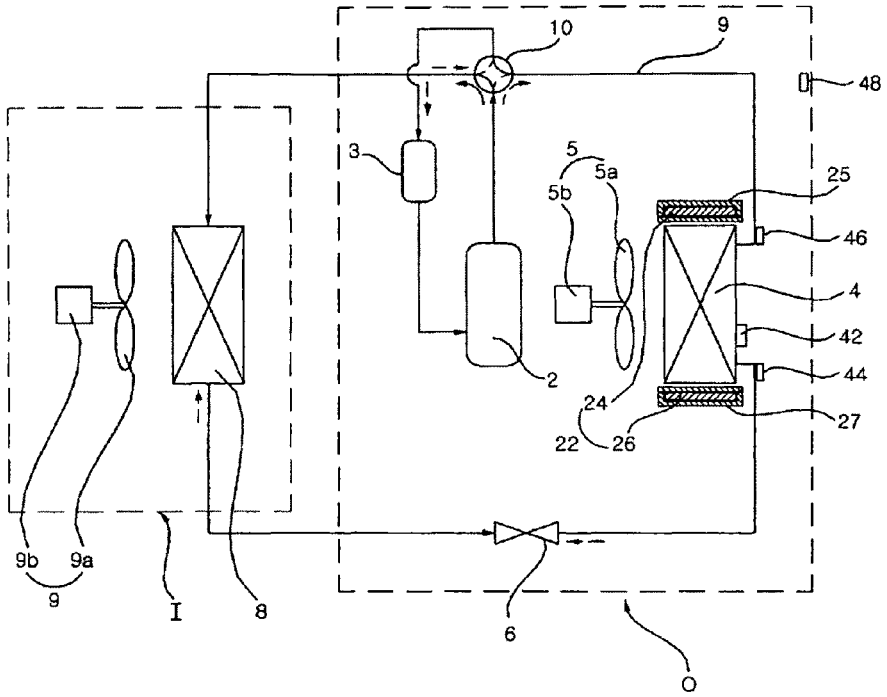
FIG. 1 illustrates a schematic diagram of an air conditioner according to an embodiment of the present invention.
Figure 2:
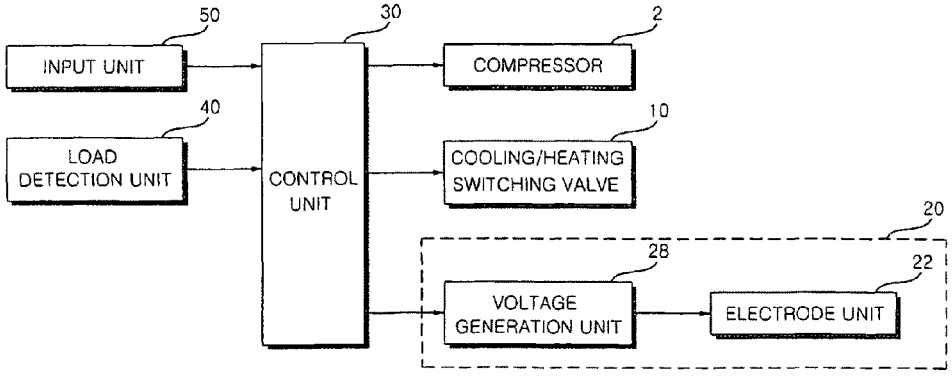
FIG. 2 illustrates a block diagram of the air conditioner illustrated in FIG. 1.

FIG. 1 illustrates a schematic diagram of an air conditioner according to an embodiment of the present invention, and FIG. 2 illustrates a block diagram of the air conditioner illustrated in FIG. 1.

Referring to FIGS. 1 and 2, the air conditioner includes a compressor 2, an outdoor heat exchanger 4, an expansion device 6, an indoor heat exchanger 8, and an anti-freeze apparatus 20 which supplies energy to the compressor 2, the outdoor heat exchanger 4, the expansion device 6 and the indoor heat exchanger 8 and can thus prevent water, if any, on the surfaces of the compressor 2, the outdoor heat exchanger 4, the expansion device 6 and the indoor heat exchanger 8 from freezing.

The air conditioner may be either an air cooler which can cool indoor rooms or a heat pump which not only can cool but also can heat indoor rooms. If the air conditioner is an air cooler, a coolant compressed by the compressor 2 is condensed by passing through the outdoor heat exchanger 5, and the condensed coolant is expanded by passing through the expansion device 6. The expanded coolant is evaporated by the indoor heat exchanger 8. Then, the evaporated coolant is circulated back into the compressor 2. That is, the outdoor heat exchanger 4 may serve as a condenser, and the indoor heat exchanger 8 may serve as an evaporator.

On the other hand, if the air conditioner is a heat pump, rather than an air cooler, the air conditioner may also include a cooling/heating switching valve 10 which shifts the passage of flow of a coolant compressed by the compressor 2 according to whether the air conditioner performs a cooling operation or a heating operation. During a cooling operation, a coolant compressed by the compressor 2 is circulated into the compressor 2 by sequentially passing through the cooling/heating switching valve 10, the outdoor heat exchanger 4, the expansion device 6, the indoor heat exchanger 4, and the cooling/heating switching valve 10. In this case, the outdoor heat exchanger 4 may serve as a condenser, and the indoor heat exchanger 8 may serve as an evaporator.

On the other hand, during a heating operation, a coolant compressed by the compressor 2 is circulated into the compressor 2 by sequentially passing through the cooling/heating switching valve 10, the indoor heat exchanger 8, the expansion device 6, the outdoor heat exchanger 5, and the cooling/heating switching valve 10. In this case, the indoor heat exchanger 8 may serve as a condenser, and the outdoor heat exchanger 4 may serve as an evaporator.

During the operation of the air conditioner, water is generated on the surface of the outdoor heat exchanger 4 or on the surface of the indoor heat exchanger 8. More specifically, if the air conditioner is an air cooler, water may be generated on the surface of the indoor heat exchanger 8. If the air conditioner is a heat pump and performs a cooling operation, water may be generated on the surface of the indoor heat exchanger 8. If the air conditioner is a heat pump and performs a heating operation, water may be generated on the surface of the outdoor heat exchanger 4. Such water on the surface of the outdoor heat exchanger 4 or the indoor heat exchanger 8 may freeze up at low temperature and may thus adversely affect the heat exchange performance of the air conditioner. Therefore, it is necessary to establish an atmosphere in which water on the surface of the outdoor heat exchanger 4 or the indoor heat exchanger 8 can be prevented from freezing even at low temperature.

The anti-freeze apparatus 20 prevents water on the surface of the outdoor heat exchanger 4 or the indoor heat exchanger 8 from freezing. If the air conditioner is an air cooler, the anti-freeze apparatus 20 may be disposed so that energy can be supplied to the indoor heat exchanger 8, and that water on the surface of the indoor heat exchanger 8 can be prevented from freezing. If the air conditioner is a heat pump, the anti-freeze apparatus 20 may be disposed so that energy can be supplied not only to the indoor heat exchanger 8 but also to the outdoor heat exchanger 8, and that water on the surface of the indoor heat exchanger 8 or the outdoor heat exchanger 4 can be prevented from freezing.

The anti-freeze apparatus 20 may prevent the freezing of water by using the phenomenon of super cooling, which is the cooling of a liquid below its freezing point without it becoming solid. The anti-freeze apparatus 20 may include a mechanical vibrator and thus prevent the freezing of water by applying mechanical vibrations to whichever of the outdoor heat exchanger 4 and the indoor heat exchanger 8 serves as an evaporator.

However, an anti-freeze apparatus 20 having a mechanical vibrator may damage the connections between a coolant pipe and whichever of the outdoor heat exchanger 4 and the indoor heat exchanger 8 serves as an evaporator, and thus may not be suitable for use in an air conditioner. Therefore, an anti-freeze apparatus 20 using the phenomenon of super cooling may be suitable for use in an air conditioner.

In general, when the temperature of an indoor room is below zero, it is more likely to perform a heating operation than to perform a cooling operation. Therefore, the anti-freeze apparatus 20 may supply energy so that water on the surface of the outdoor heat exchanger 4 can be prevented from freezing during a heating operation performed by a heat pump. However, people from cold climates may feel hot even at temperatures below zero and may thus need a cooling operation. In this case, water on the surface of the indoor heat exchanger 8 may freeze due to such low temperatures. Therefore, it is necessary to prevent water on the surface of the indoor heat exchanger 8 from freezing by using the anti-freeze apparatus 20. By doing so, it is possible to improve the performance of a cooling operation. In addition, since the indoor heat exchanger 8 is cooled by the anti-freeze apparatus 20, it is possible to further improve the performance of a cooling operation.

The outdoor heat exchanger 4 is more likely to be frozen than the indoor heat exchanger 8 due to being exposed to low-temperature outside air. Thus, the operation of the anti-freeze apparatus 20 will hereinafter be described in further detail, focusing mainly on the prevention of water on the surface of the outdoor heat exchanger 4 from freezing during a heating operation of a heat pump.

The anti-freeze apparatus 20 includes an electrode unit 22 which generates an electric field and applies the electric field to the outdoor heat exchanger 4 and a voltage generation unit 28 which applies a voltage, and more particularly, a high-frequency alternating voltage, to the electrode unit 22.

The electrode unit 22 converts a high-frequency alternating voltage provided by the voltage generation unit 28 into an electric field, and applies the electric field to the outdoor heat exchanger 4. The electrode unit 22 may include plates or wires which are formed of a metal such as copper or platinum. More specifically, the electrode unit 22 includes a plurality of electrodes 24 and 26 which are disposed on the opposite sides of the outdoor heat exchanger 4.

The electrodes 24 and 26 are covered with electrode covers 25 and 27, respectively, for the purpose of safety. The electrode covers 25 and 27 will be described later in further detail.

An electric field generated by the electrode unit 22 is caused by a high-frequency alternating voltage. The polarity of the electric field varies according to the frequency of the high-frequency alternating voltage. Thus, the electric field constantly vibrates and rotates water molecules composed of oxygen with a negative polarity (−) and hydrogen with a positive polarity (+) so that water molecules can be prevented from being crystallized and can thus be maintained to be liquid even at temperatures below the freezing point of water.

The voltage generation unit 28 generates an alternating voltage according to setting values regarding a predetermined voltage magnitude and a predetermined frequency and applies the alternating voltage to the electrode unit 22. The voltage generation unit 28 may vary at least one of the magnitude and frequency of a voltage, thereby generating an alternating voltage. More specifically, the voltage generation unit 28 generates an alternating voltage according to setting values (e.g., setting values regarding a predetermined voltage magnitude and a predetermined frequency) provided by a control unit 30 and applies the alternating voltage to the electrode unit 22 so that the electrode unit 22 can generate an electric field and apply the electric field to the outdoor heat exchanger 4. The voltage generator 28 may vary the frequency of a voltage so that the magnitude of the voltage can vary within the range of 0.5-10 KV. The voltage generator 28 may vary the frequency of a voltage within a high-frequency range ranging from 0.5 kHz to 500 kHz.

The voltage generation unit 28 applies an alternating voltage having a high frequency of 0.5-500 kHz because a voltage having a frequency lower than 0.5 kHz or higher than 500 kHz can only slightly rotate or vibrate water molecules, thereby resulting in the phase transformation of water. A voltage having a magnitude greater than 10 KV may result in dielectric breakdown of the electrode covers 25 and 27. An alternating voltage having a frequency higher than 500 kHz may spread in the form of an electric wave, instead of generating an electric field. In addition, the speed at which the polarity of an alternating voltage having a frequency higher than 500 kHz varies may be excessively high so that the movement of water molecules cannot keep up with the variation of the polarity of the alternating voltage. Thus, the optimum frequency and the optimum voltage for a voltage generated by the voltage generation unit 28 may be set to the range of 0.5-500 kHz and the range of 0.5-10 KV, respectively.

If the outdoor heat exchanger 4 or the indoor heat exchanger 8 is a pin/tube-type heat exchanger including a coolant tube, which a coolant flows therethrough and is formed of aluminum or copper, and an aluminum pin, which is disposed in the coolant tube, an electric field generated by the electrode unit 22 may concentrate on the aluminum pin and generate heat due to the resistance of the aluminum pin. In general, when a voltage having a voltage of about 7000 V is applied to a stainless material as a direct current (DC) pulse, the stainless material emits negative ions, and the negative ions give an impulse to water molecules so that the water molecules can be prevented from freezing. By using this phenomenon, it is possible to prevent the freeze of water by applying a high voltage to the aluminum pin so that negative ions emitted from the aluminum pin can give an impulse to water molecules.

That is, it is possible to maintain an anti-freeze state by applying a high voltage to the aluminum pin. In addition, it is possible to reduce the probability of the occurrence of an electric shock by grounding the aluminum pin and providing an additional active electrode.

Referring to FIG. 2, the air conditioner may also include the control unit 30 and a load sensing unit 40. The control unit 30 controls the anti-freeze apparatus 20, and particularly, the voltage generation 28, according to the state of operation of the air conditioner.

The load sensing unit 40 determines the existence of water on the surface of the outdoor heat exchanger 4 and the amount of water on the surface of the outdoor heat exchanger 4. The control unit 30 controls the anti-freeze apparatus 20 according to the results of the sensing performed by the load sensing unit 40. The load sensing unit 40 may include a temperature sensing unit which senses the temperature of a pipe connected to the outdoor heat exchanger 4, the temperature of the outdoor heat exchanger 4 or the temperature outside the room where the air conditioner is installed. Alternatively, the load sensing unit 40 may include a current detection unit or a voltage detection unit which detects a current or voltage that results from an electric field generated by the outdoor heat exchanger 4 during the operation of the anti-freeze apparatus 20.

If the load sensing unit 40 includes a temperature sensing unit, the load sensing unit 40 may include at least one of an outdoor heat exchanger temperature sensor 42 which senses the temperature of the outdoor heat exchanger 4, an inlet temperature sensor 44 which senses the temperature of a pipe at the inlet of the outdoor heat exchanger 4, an outlet temperature sensor 46 which senses the temperature of a pipe at the outlet of the outdoor heat exchanger 4, and an outdoor temperature sensor 48 which senses the temperature outside the air conditioner. The control unit 30 may determine the existence of water on the surface of the outdoor heat exchanger 4 or the amount of water on the surface of the outdoor heat exchanger 4 based on the result of the sensing performed by at least one of the outdoor heat exchanger temperature sensor 42, the inlet temperature sensor 44, the outlet temperature sensor 46, and the outdoor temperature sensor 48. Then, the control unit 30 may determine whether to drive the voltage generation unit 28 and determine a frequency and a voltage magnitude for the voltage generation unit 28.

If the load sensing unit 40 includes a current detection unit or a voltage detection unit, the resistance of the current detection unit or the voltage detection unit may vary according to the existence of water on the surface of the outdoor heat exchanger 4 or the amount of water on the surface of the outdoor heat exchanger 4. Thus, the control unit 30 may determine the existence of water on the surface of the outdoor heat exchanger 4 or the amount of water on the surface of the outdoor heat exchanger 4 based on the resistance of the current detection unit or the voltage detection unit. Then, the control unit 30 may determine whether to drive the voltage generation unit 28 and determine a frequency and a voltage magnitude for the voltage generation unit 28.

The control unit 30 may control the anti-freeze apparatus 20 not only by using the load sensing unit 40 but also by taking into consideration whether the air conditioner performs a heating operation. The control of the anti-freeze apparatus 20 by the control unit 30 will hereinafter be described in further detail.

If the air conditioner satisfies a set of anti-freeze initiation conditions, the control unit 30 may drive the anti-freeze apparatus 20. On the other hand, if the air conditioner satisfies a set of anti-freeze release conditions, the control unit 30 may terminate the operation of the anti-freeze apparatus 20.

The anti-freeze initiation conditions are the conditions in which water is generated on the surface of the outdoor heat exchanger 4 and is likely to freeze. The anti-freezing initiation conditions may include at least one of the following conditions: whether the air conditioner performs a heating operation, the amount of time for which long the compressor 2 of the air conditioner has been continuously driven, a water load condition, and an elapsed time after the initiation of an anti-freezing operation.

For example, if the air conditioner performs a heating operation, the compressor 2 has been continuously driven for more than a predefined amount of time, the temperature of the outdoor heat exchanger 4 is lower than a reference temperature, and a predefined amount of time has not yet elapsed since the initiation of an anti-freeze operation, the anti-freeze apparatus 20 may be driven. On the other hand, if the air conditioner performs an operation, other than a heating operation, the compressor 2 has been continuously driven, but for less than a predefined amount of time, the temperature of the outdoor heat exchanger 4 is higher than a reference temperature, and a predefined amount of time has already elapsed since the initiation of an anti-freeze operation, the anti-freeze apparatus 20 may not be driven.

The anti-freeze release conditions are the conditions in which an anti-freeze operation is unnecessary because no water is generated on the surface of the outdoor heat exchanger 4 or because water, if any, on the surface of the outdoor heat exchanger 4 is less likely to freeze. The anti-freeze release conditions include at least one of the following conditions: whether the air conditioner performs a heating operation and a water load condition.

For example, if a heating operation performed by the air conditioner is terminated during the operation of the anti-freeze apparatus 20 or if the temperature of the outdoor heat exchanger 4 is higher than a reference temperature, the operation of the anti-freeze apparatus 20 may be terminated.

In addition, if the air conditioner performs a heating operation, the compressor 2 has been continuously driven for more than a predefined amount of time, and the temperature of the outdoor heat exchanger 4 is lower than a reference temperature, the anti-freeze apparatus 20 may be driven regardless of an elapsed time after the initiation of an anti-freeze operation. On the other hand, if the air conditioner performs an operation, other than a heating operation, the compressor 2 has been continuously driven, but for less than a predefined amount of time, and the temperature of the outdoor heat exchanger 4 is higher than a reference temperature, the anti-freeze apparatus 2 may not be driven. If a heating operation performed by the air conditioner is terminated during the operation of the anti-freeze apparatus 20 or if the temperature of the outdoor heat exchanger 4 is higher than a reference temperature, the operation of the anti-freeze apparatus 20 may be terminated.

Referring to FIG. 1, reference numeral 3 indicates an accumulator which is disposed between the compressor 2 and a suction tube 2*a* and in which a coolant accumulates; reference numeral 5 indicates an outdoor blower 5 which includes an outdoor fan 5*a* that blows air into the outdoor heat exchanger 4 and a motor 5*b* that rotates the outdoor fan 5*a*; and reference numeral 9 indicates an indoor blower 5 which includes an outdoor fan 9*a* that blows air into the indoor heat exchanger 9 and a motor 9*b* that rotates the outdoor fan 9*a*. Referring to FIG. 2, reference numeral 50 indicates a control panel or an input unit of a remote control which is installed in an indoor unit I of FIG. 1 and enables a user to select various operating modes and an anti-freeze operation.

The embodiment of FIGS. 1 and 2 may be applied not only to an integral-type air conditioner in which an indoor unit and an outdoor unit are both integrated in one case but also to a separate-type air conditioner in which an indoor unit and an outdoor unit are separate. Assume that the air conditioner of the embodiment of FIGS. 1 and 2 is a separate-type air conditioner, and that the anti-freeze apparatus 20 is disposed in an outdoor unit O of the air conditioner illustrated in FIG. 1.

Figure 3:
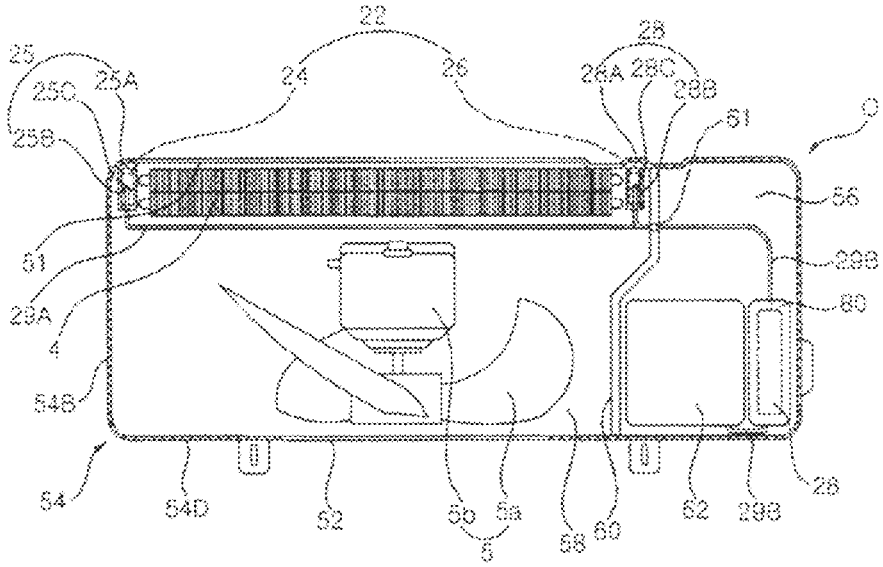
FIG. 3 illustrates a plan view of an outdoor unit of the air conditioner illustrated in FIG. 1.
Figure 4:
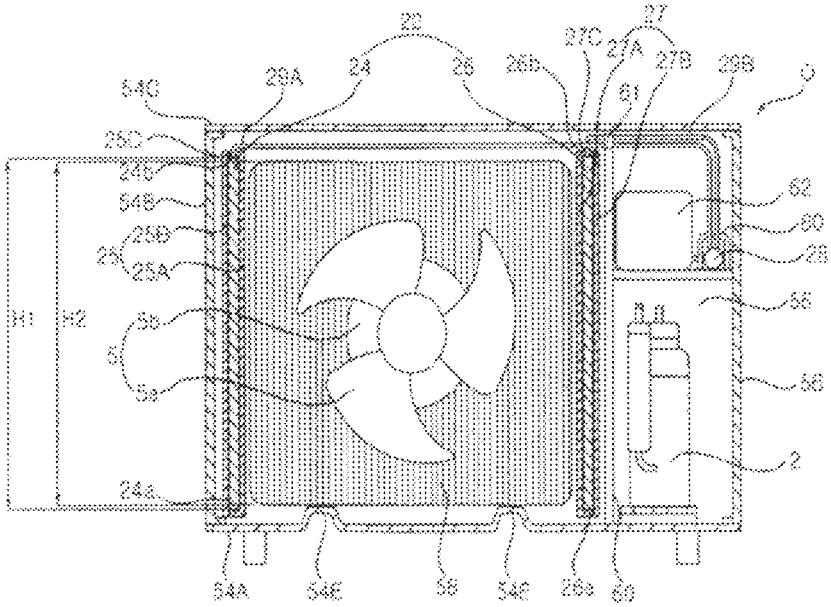
FIG. 4 illustrates a front view of the outdoor unit illustrated in FIG. 3.

FIG. 3 illustrates a plan view of the outdoor unit O, and FIG. 4 illustrates a front view of the out door unit O illustrated in FIG. 3.

Referring to FIGS. 3 and 4, the outdoor unit O includes a casing 54 which has an air inlet 51 and an air outlet 52 through which air is injected into and ejected from the casing 54; and a barrier wall 60 which is divides the inner space of the casing 54 into a machine room 56 and a flow path room 58. The compressor 2 is disposed in the machine room 56, and the outdoor heat exchanger 4 is disposed in the flow path room 58.

The accumulator 3 and the expansion device 6 are disposed in the machine room 56 of the outdoor unit O along with the compressor 2.

The casing 54 includes a base 54A which has legs; a cabinet 54B which is disposed on the base 54A and has an air inlet 51 disposed on at least one surface of the cabinet 54B; a front cover 54C which is disposed at the front of the cabinet 54B and has an air outlet 52; and a top cover 54D which covers the top of the cabinet 5413.

The casing 54 may be entirely formed of a dielectric material. Alternatively, only the portions of the casing 54 near the electrodes 24 and 26 may be formed of a dielectric material.

The outdoor unit O may be installed so that the outdoor heat exchanger 4 can become in the vicinity of the air inlet 51. Only the cabinet 54B of the outdoor unit O, which is adjacent to the outdoor heat exchanger 4, may be formed of a dielectric material. Alternatively, the cabinet 54B and the top cover 54D may be formed of a dielectric material, whereas the base 54A, which needs to have high rigidity, and the front cover 54C, which is relatively distant apart from the electrode unit 22, may be formed of a highly rigid material.

The outdoor blower 5 is disposed in the outdoor unit O. The outdoor fan 5A of the outdoor blower 5 is disposed in the flow path room 58 and between the air inlet 51 and the air outlet 52 so that air can be injected into the outdoor unit O through the air inlet 51 and ejected from the outdoor unit O through the air outlet 52.

The barrier wall 60 may be formed of a dielectric material.

The outdoor unit O also includes a control box 62 in which various automotive electric elements of the control unit 30 such as automotive electric elements for controlling the compressor 2 are installed. The control box 62 may be disposed either in the machine room 56 or in the flow path room 58.

All or some of the automotive electric elements of the control unit 30 may be installed in the control box 62.

The electrode unit 22, including the electrodes 24 and 26, is disposed in the flow path room 56.

The electrodes 24 and 26 may be disposed not to block the passage of the flow of air from the outside of the outdoor unit O and thus not to interrupt with the flow of air. The electrodes 24 and 26 may be disposed on the left and right sides, respectively, of the outdoor heat exchanger 4. Alternatively, the electrodes 24 and 26 may be disposed above and below, respectively, the outdoor heat exchanger 4. In this case, the electrodes 24 and 26 may be vertically aligned with each other or may be disposed diagonally with respect to the outdoor heat exchanger 4.

The electrode covers 25 and 27 may be electrode housings and cover the electrodes 24 and 26, respectively. The electrode covers 25 and 27 may be formed of a dielectric material such as plastic.

The electrode covers 25 and 27 may include electrode boxes 25A and 27A, respectively, and covers 25B and 27B, respectively. Each of the electrode boxes 25A and 27A has one surface opened and may thus be able to hold the electrode 24 or 26. The covers 25B and 27B respectively cover the opened surfaces of the electrode boxes 25A and 27B. Alternatively, the electrode covers 25 and 27 may be formed as housings through injection molding so that the electrodes 24 and 26 can be inserted into the electrode covers 25 and 27, respectively.

As many electrode covers 25 and 27 as there are electrodes 24 and 26 may be provided. The electrode covers 25 and 27 may cover the electrodes 24 and 26, respectively.

An electric field may not be uniformly generated at lower and upper ends 24*a* and 24*b* of the electrode 24 and at lower and upper ends 26*a* and 26*b* of the electrode 26. In order to provide a relatively uniform electric field to the outdoor heat exchanger 4 and thus to stably maintain an anti-freeze state, the outdoor heat exchanger 4 may be distant apart from each of the lower and upper ends 24*a* and 24*b* of the electrode 24 and the lower and upper ends 26*a* and 26*b* of the electrode 26.

That is, a height H1 of the electrodes 24 and 26 is less than a height H2 of the outdoor heat exchanger 4. The lower ends 24*a* and 26*a* of the electrodes 24 and 26 are disposed lower than the bottom of the outdoor heat exchanger 4, and the upper ends 24*b* and 26*b* of the electrodes 24 and 26 are disposed higher than the top of the outdoor heat exchanger 4.

Referring to FIGS. 3 and 4, the air conditioner may also include an isolation unit which isolates the outdoor heat exchanger 4 from the lower ends 24*a* and 26*a* of the electrodes 24 and 26.

The isolation unit includes supporters 54E. The supporters 54E support the outdoor heat exchanger 4 so that the outdoor heat exchanger 4 can be disposed higher than the lower ends 24*a* and 26*a* of the electrodes 24 and 26.

The supporters 54E may be formed on the top surface of the base 54A. Alternatively, referring to FIG. 4, portions of the base 54A may protrude beyond the top surface of the base 54A and may thus respectively form the supporters 54E.

The intensity of an electric field applied to the outdoor heat exchanger 4 may vary from one portion to another portion of the outdoor heat exchanger 4, instead of being uniform across the entire outdoor heat exchanger 4, and thus, the temperature at the corners of the outdoor heat exchanger 4 may be considerably discrepant from the temperature at the rest of the outdoor heat exchanger 4. In this case, an anti-freeze state may become unstable, and nuclei may be formed in water molecules so that water can freeze due to a failure to maintain super cooling. Thus, referring to FIG. 4, the outdoor heat exchanger 4 may have rounded corners. As a result, the outdoor heat exchanger 4 may be distant apart from the electrodes 24 and 26, a uniform electric field may be applied to the outdoor heat exchanger 4, and an anti-freeze state may be further stabilized.

The voltage generation unit 28 may be disposed in the machine room 56 or may be disposed in the flow path room 56 along with the electrode unit 22.

If the voltage generation unit 28 is disposed in the machine room 56, the probability of the voltage generation unit 28 malfunctioning due to an electric field may be minimized, and the voltage generation unit 28 may be easily controlled and serviced due to being adjacent to the control box 62. On the other hand, if the voltage generation unit 28 is disposed in the flow path room 58, heat generated by the voltage generation unit 28 may be dissipated due to air that passes through the flow path room 58, and thus, the stability of the voltage generation unit 28 may be improved.

The voltage generation unit 28 is connected to the electrode unit 22 through wires 29A and 29B and is connected to the control box 62 through a wire 29C. Thus, if the voltage generation unit 28 is disposed in the machine room 56, the wires 29A and 29B may pass through the barrier wall 60 or make a detour round the barrier wall 60. On the other hand, if the voltage generation unit 28 is disposed in the flow path room 56, the wire 29C may pass through the barrier wall 60 or make a detour round the barrier wall 60.

The stability of the wires 29A and 29B may be compromised when the wires 29A and 29B are in contact with water, if any, on the surface of the base 54A. Thus, the wires 29A and 29B may be disposed at an upper part of the outdoor unit O. More particularly, the wires 29A and 29B may be connected to the upper ends 24*a* and 26*a*, respectively, of the electrodes 24 and 26.

Connectors may be respectively installed and exposed on the electrode covers 25 and 27. The connectors may electrically connect the electrodes 24 and 26 to the wires 29A and 29B, respectively. Alternatively, wire through holes 25C and 27C may be formed through the electrode covers 25 and 27, respectively, so that the wires 29A and 29B can be respectively connected to the electrodes 24 and 26 through the wire through holes 25C and 27C.

If the connectors are disposed outside the respective electrode covers 25 and 27, the wires 29A and 29B may be easily connected to or disconnected from the connectors, but the probability of water infiltrating into the connectors may become high. Thus, the wires 29A and 29B may be respectively connected to the electrodes 24 and 26 through the electrode covers 25 and 27.

A wire through groove or a wire through hole 61 via which at least one of the wires 29A through 29C can pass through the barrier wall 60 may be formed on the barrier wall 60.

Referring to FIGS. 3 and 4, reference numeral 80 indicates a dielectric element which covers the voltage generation unit 28 for the safety of the voltage generation unit 28.

Figure 5:
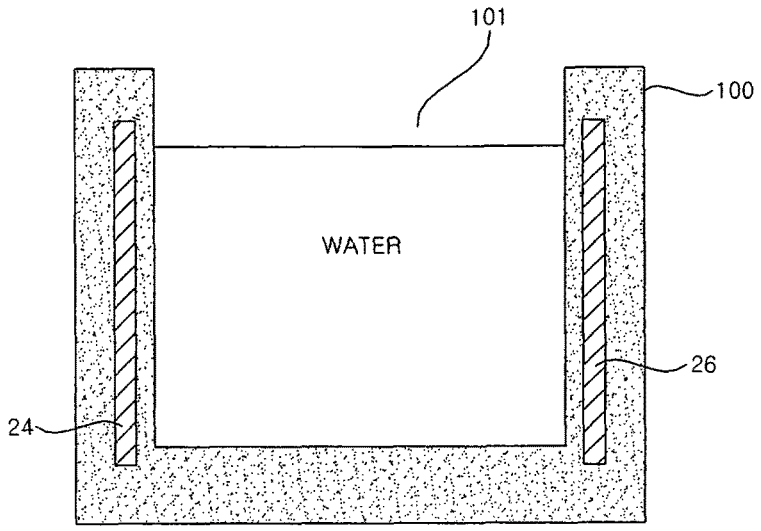
FIG. 5 illustrates a structure for experimenting a supercooling phenomenon of an air conditioner according to an embodiment of the present invention.
Figure 6:
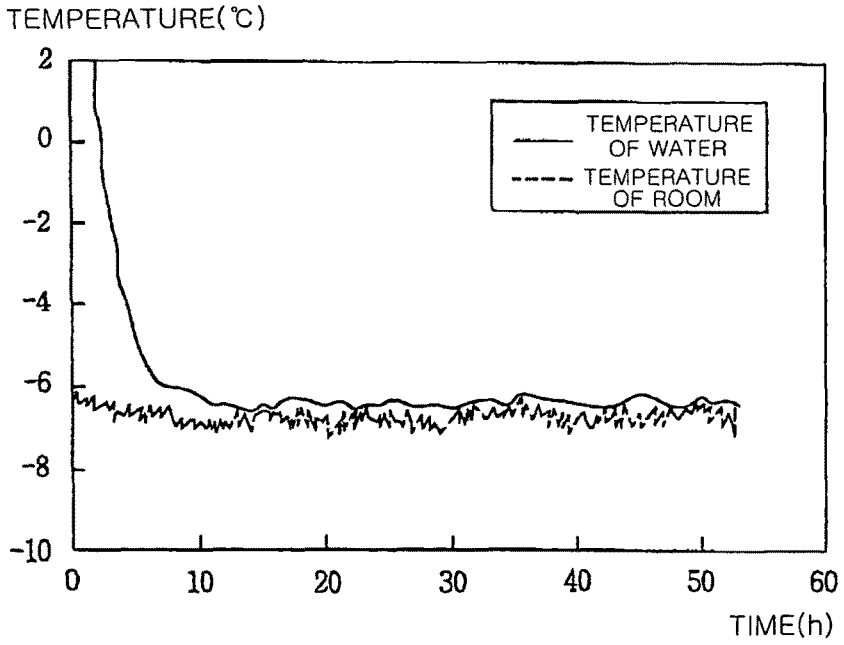
FIG. 6 illustrates a graph of super-cooling measurement results obtained using the structure illustrated in FIG. 5.

FIG. 5 illustrates a structure for testing a super-cooling phenomenon of an air conditioner according to an embodiment of the present invention, and FIG. 6 illustrates a graph of experimental results obtained using the structure illustrated in FIG. 5.

Referring to FIG. 5, a space 101 for containing water therein is formed in a case 100. 0.1 L of distilled water is contained in the space 101. A plurality of electrodes 24 and 26 are installed inside the case 100 and are disposed at the opposite sides of the space 101. The length of the electrodes 24 and 26 is greater than the height of water in the space 101. The width of the electrodes 24 and 26 is 20 mm. The case 100 is formed of a dielectric material such as an acrylic material. An alternating voltage of 0.91 KV (6.76 mA, 20 kHz) is applied to the electrodes 24 and 26 using a voltage generation unit 28, and the case 100 is cooled so that the temperature in the space 101 can reach about −7° C.

Figure 7:
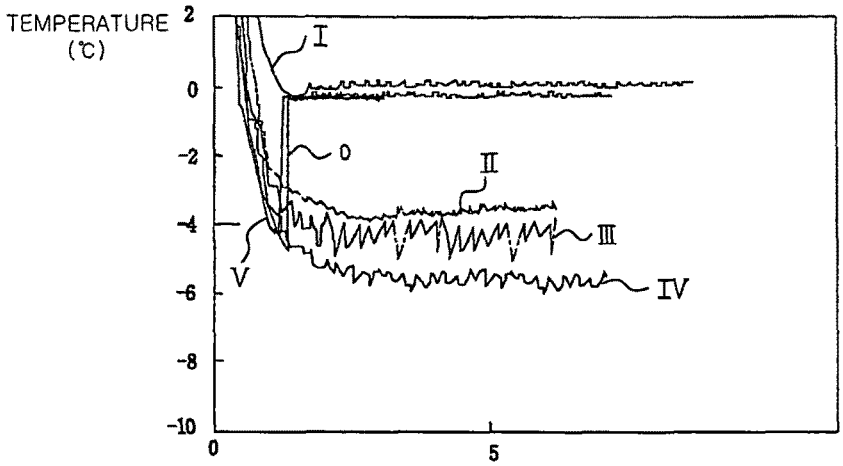
FIG. 7 illustrates a graph of anti-freeze temperature measurements for different amounts of power obtained using the structure illustrated in FIG. 5.

FIG. 7 illustrates a graph of anti-freeze temperature measurement results for different amounts of power obtained using the structure illustrated in FIG. 5. The measurement results of FIG. 7 were obtained by maintaining the temperature of the space 101 of the case 100 at −6° C., setting a plurality of amounts of power to be applied by the voltage generation unit 28, and applying the plurality of amounts of power. Referring to a reference line O of FIG. 7, when no power is applied, an anti-freeze state is maintained until the temperature of the space 101 reaches −5° C. Then, a freeze state begins less than three hours after the onset of the anti-freeze state.

Referring to a first energy line I (1.38 W) of FIG. 7, since a large amount of energy is applied to water, the temperature of water is almost uniformly maintained at 0° C., and thus, super cooling does not occur even if water begins to freeze at its freezing point (a temperature of 0° C. at a pressure of 1 atm).

Referring to a second energy line II (0.98 W) of FIG. 7, an anti-freeze state caused by a super cooling phenomenon is maintained, and an anti-freeze temperature is maintained within the range of −3° C. and −3.5° C.

Referring to a third energy line III (0.91 W) of FIG. 7, an anti-freeze state caused by a super cooling phenomenon is maintained, and an anti-freeze temperature is maintained within the range of −4° C. and −5° C.

Referring to a fourth energy line IV (0.62 W) of FIG. 7, an anti-freeze state caused by a super cooling phenomenon is maintained, and an anti-freeze temperature is maintained within the range of −5.5° C. and −5.8° C.

Referring to a fifth energy line V (0.36 W), no super cooling state is achieved, so water freezes, i.e., a phase transition of water occurs.

Figure 8:
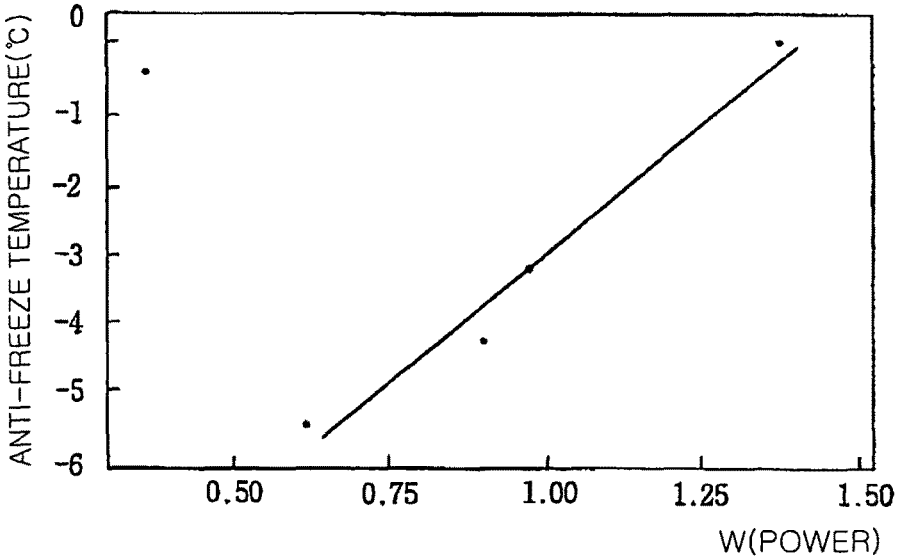
FIG. 8 illustrates a graph of the correlation between first through fifth energy lines illustrated in FIG. 7.

FIG. 8 illustrates a graph of the correlation between the first through fifth energy lines illustrated in FIG. 7. Referring to FIG. 8, the amount of energy applied to water is proportional to an anti-freeze temperature of water. The greater the amount of energy applied to water, the higher the anti-freeze temperature becomes. On the other hand, the less the amount of energy applied to water, the lower the anti-freeze temperature becomes. However, if too little energy is applied, the motion of water molecules may not be active enough to realize a super cooling state, and thus, water may freeze, as in the case of the fifth energy line of FIG. 7.

Figure 9:
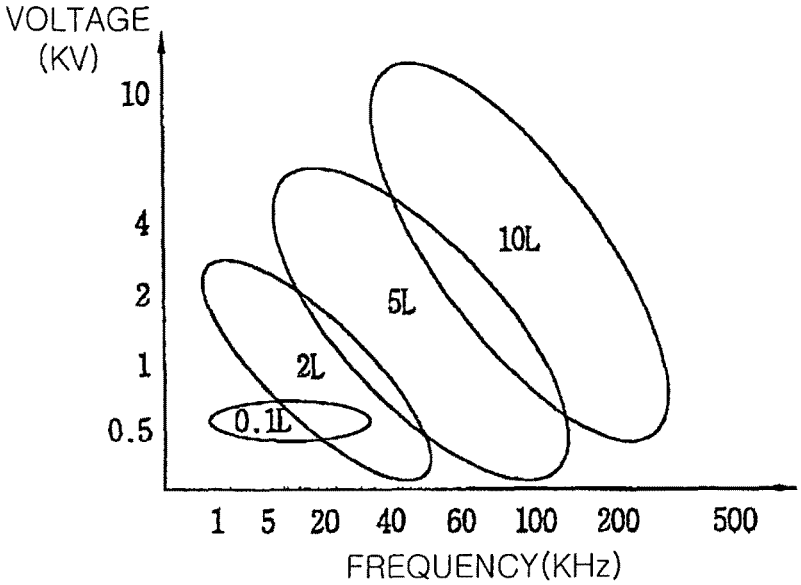
FIG. 9 illustrates a graph of the relationships between a voltage and a frequency for maintaining an anti-freeze state for different amounts of water in an air conditioner.

FIG. 9 illustrates a graph of the relationship between an optimum voltage and an optimum frequency band for maintaining an anti-freeze state for different amounts of water in an air conditioner. Referring to FIG. 9, the optimum voltage and an optimum frequency band for maintaining an anti-freeze state must be appropriately determined in accordance with an increase in the amount of water, for example, from 0.1 l to 2 l, from 2 l to 5 l or from 5 l to 10 l. If the optimum frequency band and the optimum voltage are set to the range of 0.5-500 kHz and the range of 0.5-10 KV, respectively, an anti-freeze state of water may be effectively maintained regardless of a variation in the amount of water. Given that, in general, less than 0.1 l of condensed water is generated regardless of the size of the outdoor heat exchanger 4, the optimum frequency band and the optimum voltage may be set to the range of 0.5-40 kHz and the range of 0.5-1 KV, respectively.

The operation of the air conditioner of the embodiment of FIGS. 1 and 2 will hereinafter be described in further detail.

Figure 10:
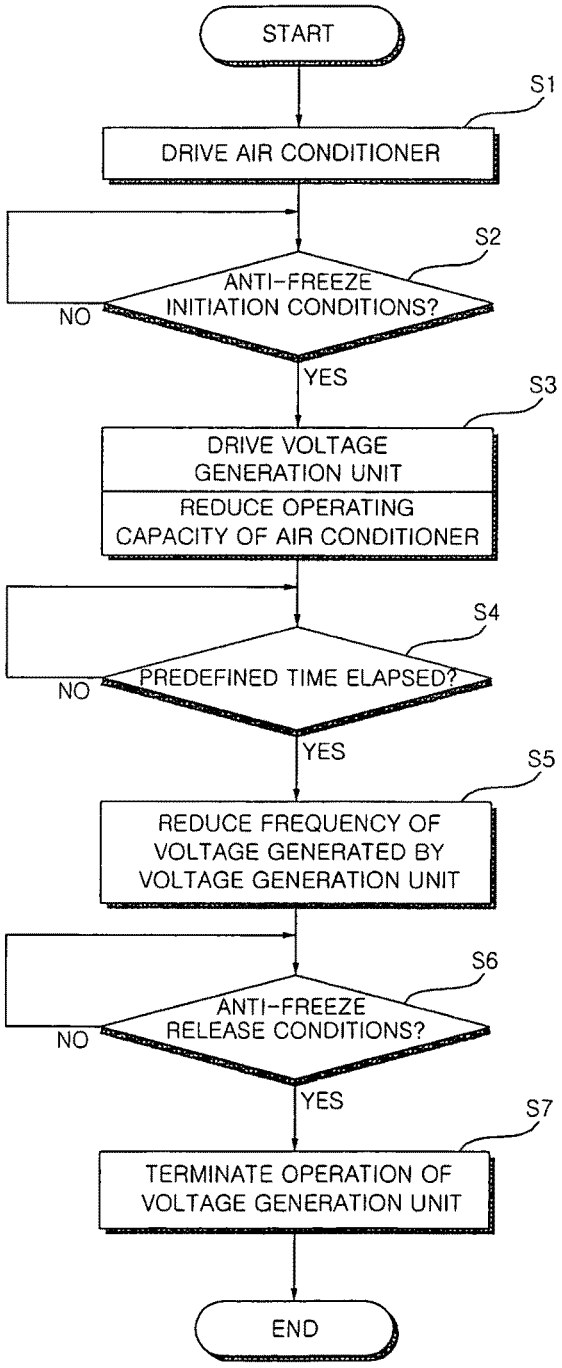
FIG. 10 illustrates a flowchart of a method of controlling an air conditioner according to an embodiment of the present invention.

FIG. 10 illustrates a flowchart of a method of controlling an air conditioner according to an embodiment of the present invention. Referring to FIG. 10, during a cooling operation of the air conditioner, the control unit 30 drives the compressor 2, controls the cooling/heating switching valve 10 to operate in a cooling mode, and drives the motor 9B of the indoor blower 9 and the motor 5B of the outdoor blower 5 (S1).

During a cooling operation of the air conditioner, a coolant sequentially passes through the outdoor heat exchanger 4, the expansion device 6, the indoor heat exchanger 8 and the compressor 2, the indoor heat exchanger 8 removes heat from air in a room in which the air conditioner is installed, and the outdoor heat exchanger 4 releases the heat to the outside of the room.

On the other hand, during a heating operation of the air conditioner, the control unit 30 drives the compressor 2, controls the cooling/heating switching valve 10 to operate in a heating mode, and drives the motor 9B of the indoor blower 9 and the motor 5B of the outdoor blower 5.

During a heating operation of the air conditioner, a coolant sequentially passes through the compressor 2, the indoor heat exchanger 8, the expansion device 6, the outdoor heat exchanger 4 and the compressor 2, the outdoor heat exchanger 4 removes heat from air from the outside of the room and the outdoor heat exchanger 4 releases the heat into the room (S1).

During a heating operation of the air conditioner, condensed water is generated on the surface of the outdoor heat exchanger 4, and the control unit 30 drives the anti-freeze apparatus 20 if the air conditioner satisfies a set of anti-freeze initiation conditions (S2 and S3).

For example, if the air conditioner is currently performing a heating operation, the compressor 2 has been continuously driven for more than a predefined amount of time (e.g., for more than ten minutes), and the temperature of the outdoor heat exchanger 4 is lower than a reference temperature (e.g., a temperature 2° C. higher than the freezing point of water), the control unit 30 may drive the anti-freeze apparatus 20.

More specifically, the control unit 30 controls the voltage generation unit 28 to apply a voltage having a predefined magnitude and belonging to a predefined frequency band to the electrodes 24 and 26. Then, an electric field is generated between the electrodes 24 and 26 of the electrode unit 22.

The electric field continuously vibrates and rotates water molecules on the surface of the outdoor heat exchanger 4 so that the water molecules can become in a super-cooling state even before reaching the freezing point of water. Therefore, due to the electric field, water on the surface of the outdoor heat exchanger 4 can be prevented from freezing.

In other words, the air conditioner can perform a heating operation while preventing water on the surface of the outdoor heat exchanger 4 from freezing. Thus, there is no need to perform a defrost operation during a heating operation of the air conditioner.

During the operation of the anti-freeze apparatus 20, the control unit 30 lowers the operating capacity of the air conditioner, and particularly, the operating capacity of the compressor 2 and the expansion device 6, so that severe temperature variations can be prevented, and that an anti-freeze operation can be stably performed.

When a predefined amount of time (e.g., three minutes) elapses after the initiation of the operation of the anti-freeze apparatus 20, the control unit 30 controls the voltage generation unit 28 to reduce the frequency of the voltage applied to the electrodes 24 and 26 of the electrode unit 22 and thus to reduce the power consumption of the air conditioner (S4 and S5).

The predefined amount of time is the time taken to stabilize an anti-freeze state and may be experimentally determined.

Once the anti-freeze state is stabilized, the motion in water molecules becomes regular and thus becomes less affected by a reduction in the frequency of the voltage applied to the electrodes 24 and 26. Therefore, the anti-freeze state can be uniformly maintained.

The control unit 30 terminates the operation of the anti-freeze apparatus 20 if the air conditioner satisfies a set of anti-freeze release conditions (S6 and S7).

For example, if a heating operation of the air conditioner is terminated during the operation of the anti-freeze apparatus 20 or if the temperature of the outdoor heat exchanger 4 is higher than a reference temperature (e.g., a temperature 2° C. higher than the freezing point of water), the control unit 30 may terminate the operation of the anti-freeze apparatus 20.

In other words, the control unit 30 cuts off the voltage applied to the electrodes 24 and 26 of the electrode unit 22 so that no electric field can be generated in the outdoor heat exchanger 4 any longer.

Figure 11:
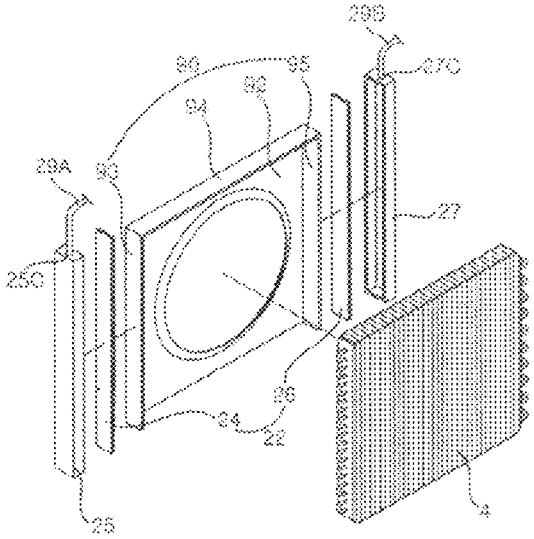
FIG. 11 illustrates an exploded perspective view of an air conditioner according to another embodiment of the present invention.
Figure 12:
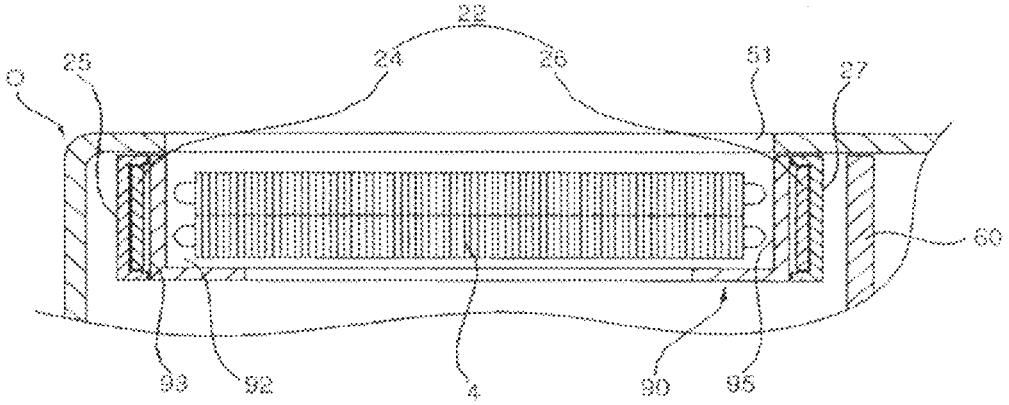
FIG. 12 illustrates a partial plan view of the air conditioner illustrated in FIG. 11.

FIG. 11 illustrates an exploded perspective view of an air conditioner according to another embodiment of the present invention, and FIG. 12 illustrates a plan view of the air conditioner illustrated in FIG. 11.

Referring to FIGS. 11 and 12, the air conditioner includes an air guide 90 which generates the path of flow of air blown by an outdoor fan in an outdoor unit O and is formed of a dielectric material. A container unit 92 which holds an outdoor heat exchanger 4 is disposed in the air guide 90, and an electrode unit 22 which generates an electric field in the container unit 92, is also disposed in the air guide 90.

The air guide 90 may include a left portion 93, an upper portion 94 and a right portion 95 and thus surround the left, right and upper portions of the outdoor heat exchanger 4. Alternatively, the air guide 90 may include not only the left portion 93, the upper portion 94 and the right portion 95 but also a lower portion and an empty space, which is defined by the left portion 93, the upper portion 94, the right portion 95 and the lower portion of the air guide 90 and can hold the outdoor heat exchanger 4 therein, and thus surround the left, right, upper and lower portions of the outdoor heat exchanger 4.

A plurality of electrodes 24 and 26 of an electrode unit 22 may be disposed on both inner sides of the air guide 90, and a plurality of electrode covers 25 and 27 may also be disposed on the both inner sides of the air guide 90, may be formed as boxes and may thus surround the electrodes 24 and 26, respectively. Alternatively, the electrodes 24 and 26 of the electrode unit 22 may be disposed on both outer sides of the air guide 90, and the electrode covers 25 and 27 may also be disposed on the both outer sides of the air guide 90, may be formed as boxes and may thus surround the electrodes 24 and 26, respectively.

That is, the air guide 90 may protect the outdoor heat exchanger 4, provide the path of flow of air, and serve as an element for installing the electrodes 22 and 24.

The air conditioner of the embodiment of FIG. 11 has the same structure as the air conditioner of the embodiment of FIGS. 1 and 2 except the air guide 90 and the electrode covers 25 and 27, and thus, a detailed description of the structure of the air conditioner of the embodiment of FIG. 11 will be skipped.

Figure 13:
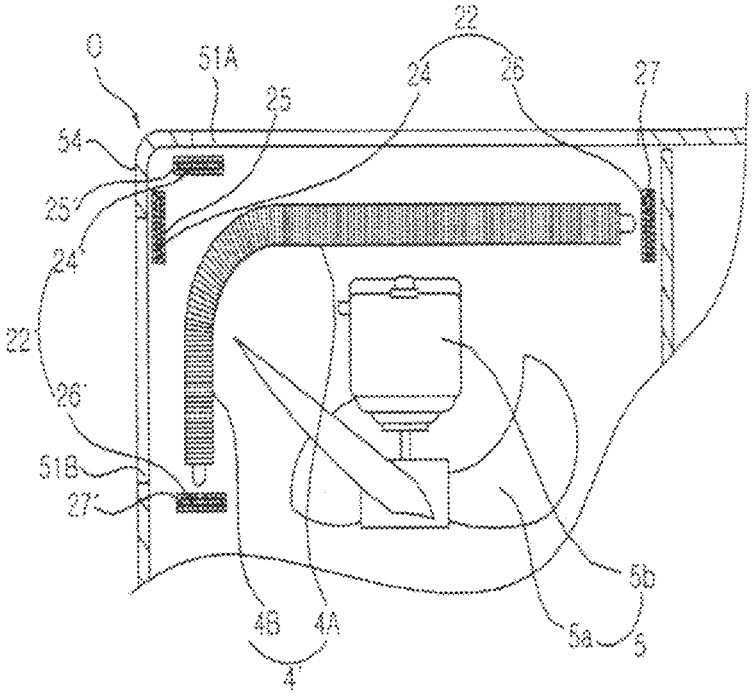
FIG. 13 illustrates a partial plan view of an air conditioner according to another embodiment of the present invention.

FIG. 13 illustrates a partial plan view of an air conditioner according to another embodiment of the present invention. Referring to FIG. 13, the air conditioner includes a casing 54' which has a plurality of surfaces through which air can be injected into the casing 54' an outdoor heat exchanger 4' which exchanges heat with air injected into the outdoor heat exchanger 4' and a plurality of electrode units 22 and 22' which are disposed in an outdoor unit O.

The casing 54' includes an air inlet 51A which is disposed on one surface of the casing 54' and an air inlet 5113 which is disposed on another surface of the casing 54'. The outdoor heat exchanger 4' includes a first heat exchange portion 4A which faces the air inlet 51A and exchanges heat with air injected thereinto through the air inlet 51A; and a second heat exchange portion 4B which faces the air inlet 51B and exchanges heat with air injected thereinto through the air inlet 51B.

For convenience, assume that the outdoor heat exchanger 4' includes a rear heat exchange portion 4A, which extends in a latitudinal direction and exchanges heat with air injected thereinto from the rear of the outdoor unit O, and a lateral heat exchange portion 4B, which extends in a longitudinal direction and exchanges heat with air laterally injected thereinto from the lateral sides of the outdoor unit O.

The positions of the electrode units 22 and 22' are determined according to the structure of the outdoor heat exchanger 4' i.e., the arrangement of the rear heat exchange portion 4A and the lateral heat exchange portion 4B. More specifically, a pair of electrodes 24 and 26 of the electrode unit 22 are disposed on both sides of the rear heat exchange portion 4A, and the electrodes 24 and 26 are surrounded by dielectric elements 25 and 27, respectively. Likewise, a pair of electrodes 24' and 26' of the electrode unit 22' are disposed on both sides of the lateral heat exchange portion 4B, and the electrodes 24' and 26' are surrounded by dielectric elements 25' and 27' respectively.

The electrode units 22 and 22' may be connected to one voltage generation unit. Alternatively, the electrode units 22 and 22' may be connected to different voltage generation units which are both connected to a control unit 30.

The control unit 30 may control the electrode units 22 and 22' to reciprocally generate an electric field.

The control unit 30 may control the voltage generation unit 28 to sequentially apply a voltage to the electrodes 24 and 26 and the electrodes 24' and 26' or to generate an electric field at the same time. An off period during which a voltage is not applied may be set. For example, the electrodes 24 and 26 may be turned on first. The electrodes 24 and 26 may be turned off a predefined amount of time after they are turned on. Then, the electrodes 24' and 26' may be turned on immediately or a predefined amount of time after the electrodes 24 and 26 are turned off. The electrodes 24' and 26' may be turned off a predetermined amount of time after they are turned on. In this manner, it is possible to maintain the motion of water molecules and thus to reduce the power consumption of an air conditioner, compared to the situation when the electrode units 22 and 22' generate an electric field at the same time.

Figure 14:
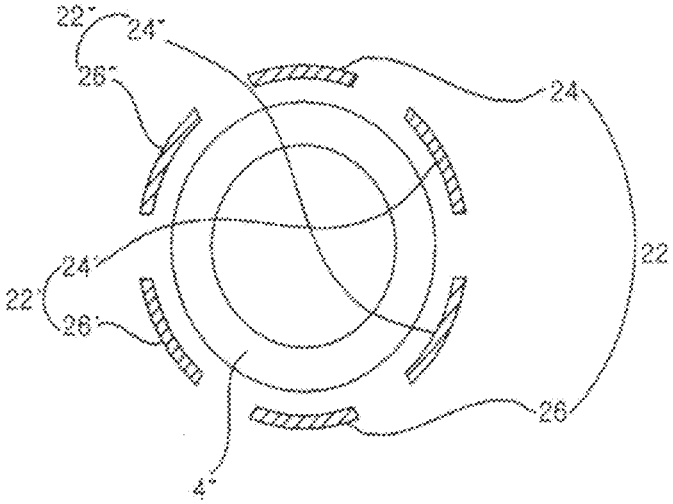
FIG. 14 illustrates a schematic diagram of an air conditioner according to another embodiment of the present invention.

FIG. 14 illustrates a schematic diagram of an air conditioner according to another embodiment of the present invention. Referring to FIG. 14, the air conditioner includes an outdoor heat exchanger 4" which is formed as a cylinder with round edges and a plurality of electrode units 22, 22' and 22" which surround the outer circumference of the outdoor heat exchanger 4". The electrode units 22, 22' and 22" includes a first pair of electrodes 24 and 26, a second pair of electrodes 24' and 26' and a third pair of electrodes 24" and 26", respectively, which are curved. For convenience, assume that only the three pairs of electrodes are provided.

The first pair of electrodes 24 and 26, the second pair of electrodes 24' and 26' and the third pair of electrodes 24" and 26" are all a predetermined distance apart from the outer circumference of the outdoor heat exchanger 4".

A voltage generation unit 28 sequentially applies a voltage to the first pair of electrodes 24 and 26, the second pair of electrodes 24' and 26' and the third pair of electrodes 24" and 26" for a predefined amount of time so that the direction of an electric field generated in the outdoor heat exchanger 4" can be varied. Accordingly, the motion of water molecules on the surface of the outdoor heat exchanger 4" can be activated, and an anti-freeze state can be stabilized even at low temperature.

While the present invention has been particularly shown and described with reference to exemplary embodiments thereof, it will be understood by those of ordinary skill in the art that various changes in form and details may be made therein without departing from the spirit and scope of the present invention as defined by the following claims.

INDUSTRIAL APPLICABILITY

According to the present invention, an anti-freeze apparatus supplies energy to a heat exchanger and can thus prevent the freeze of water on the surface of the heat exchanger during an operation of an air conditioner. Therefore, there is no need to perform a defrost operation during an operation of an air conditioner. The present invention can be applied to air conditioner which can continuously perform an air conditioning function.

The invention claimed is:

1. An air conditioner comprising:

a heat exchanger which exchanges heat with air by passing a coolant therethrough; and an anti-freeze apparatus which prevents the freeze of water on the surface of the heat exchanger by supplying energy to the heat exchanger, wherein the anti-freeze apparatus comprises an electric field generation unit which generates an electric field in the heat exchanger, wherein the electric field generation unit comprises a plurality of electrodes which are disposed on opposite sides of the heat exchanger, the air conditioner further comprises a plurality of electrode covers which are formed of a dielectric material and in which the respective electrodes are installed, wherein each of the electrode covers comprises an electrode box which has one surface opened and can thus hold a corresponding electrode therein and a cover which covers the opened surface of the electrode box.

2. The air conditioner of claim 1, wherein the electrode covers are formed through injection molding so that the electrodes can be respectively inserted in the electrode covers.

3. The air conditioner of claim 1, further comprising wires which connect a voltage generation unit and the electrodes, wherein each of the electrode covers comprises a wire through hole through which the wires pass.

4. An air conditioner comprising:

a heat exchanger which exchanges heat with air by passing a coolant therethrough; and an anti-freeze apparatus which prevents the freeze of water on the surface of the heat exchanger by supplying energy to the heat exchanger, wherein the anti-freeze apparatus comprises an electric field generation unit which generates an electric field in the heat exchanger, wherein the anti-freeze apparatus further comprises a voltage generation unit which applies a voltage to the electric field generation unit, the air conditioner further comprises a casing which comprises an air inlet and an air outlet through which air is injected and ejected; and a barrier wall which divides the inner space of the casing into a machine room in which a compressor is disposed and a flow path room in which the heat exchanger is disposed, wherein the electric field generation unit is disposed in the flow path room, the air conditioner further comprises a fan which is disposed in the flow path room, injects air through the air inlet and ejects the air through the air outlet; and an air guide which is disposed in the flow path room, guides the path of flow of air circulated by the fan and is formed of a dielectric material, wherein the air guide comprises a container in which the heat exchanger is contained and the electric field generation unit is installed in the air guide so as to be able to generate an electric field in the container.

5. A method of controlling an air conditioner, the method comprising:

performing an anti-freeze operation by applying a voltage to one or more electrodes for generating in a heat exchanger an electric field that interferes with the freeze of water if the heat exchanger satisfies a set of anti-freeze initiation conditions; and cancelling the anti-freeze operation by cutting off the voltage if the heat exchanger satisfies a set of anti-freeze release conditions, wherein the performing the anti-freeze operation, comprises reducing the voltage or a frequency applied to the electrodes a predefined amount of time after the initiation of the anti-freeze operation.

* * * * *